US006538610B2

(12) United States Patent
Noro et al.

(10) Patent No.: US 6,538,610 B2
(45) Date of Patent: Mar. 25, 2003

(54) SIGNAL TRANSMISSION CIRCUIT FOR CARRYING TRANSMISSION THROUGH A GLASS PLATE

(75) Inventors: Junichi Noro, Akita (JP); Hirokazu Awa, Akita (JP); Masaaki Miyata, Atsugi (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 09/973,315

(22) Filed: Oct. 9, 2001

(65) Prior Publication Data

US 2002/0044095 A1 Apr. 18, 2002

(30) Foreign Application Priority Data

Oct. 13, 2000 (JP) ..... 2000-312894

(51) Int. Cl.[7] ..... H01Q 1/32
(52) U.S. Cl. ..... 343/713; 343/715
(58) Field of Search ..... 343/713, 715, 343/860, 850, 861, 862; 333/24

(56) References Cited

U.S. PATENT DOCUMENTS 5,557,290 A * 9/1996 Watanabe ..... 343/713

5,682,168 A * 10/1997 James et al. ..... 343/713

* cited by examiner

*Primary Examiner*—Don Wong
*Assistant Examiner*—James Clinger
(74) *Attorney, Agent, or Firm*—Frishauf, Holtz, Goodman & Chick, P.C.

(57) ABSTRACT

In order to transmit a signal received in a GPS antenna (20) to a GPS receiver body (30) through a glass plate (40), a signal transmission circuit (10) is divided into first and second signal transmission parts (11, 12). The first signal transmission part (11) is for transmitting a high frequency signal from an output terminal ($\mathbf{20}_{out}$) of the GPS antenna (20) to a first surface (41) of the glass plate (40). The second signal transmission part (12) is for transmitting the high frequency signal from a second surface (42) of the glass plate (40) to an input terminal ($\mathbf{30}_{in}$) of the GPS receiver body (30). The first signal transmission part (11) includes a first coaxial cable (111), a first electrode pair (112), a first balanced line (113), and a first balun (114). The second signal transmission part (12) includes a second coaxial cable (121), a second electrode pair (122), a second balanced line (123), and a second balun (124).

2 Claims, 1 Drawing Sheet

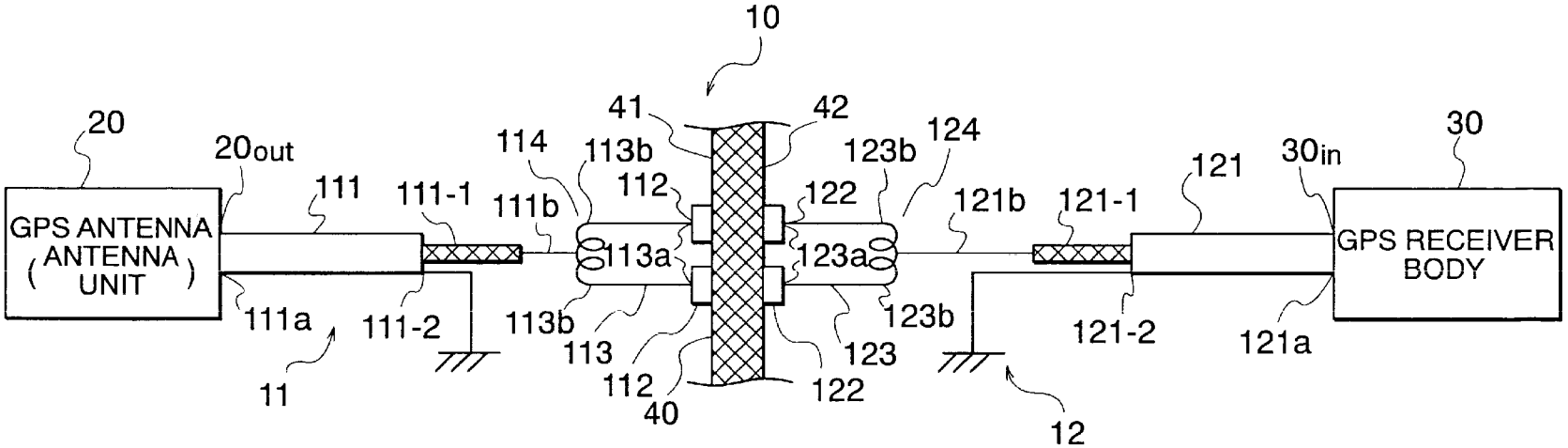
GPS RECEIVER BODY
30
30in
121a
121
121-2
121-1
12
121b
124
123b
123b
123
122
123a
122
42
10
41
113b
112
113a
112
40
113
114
111b
113b
111-1
111-2
111
111a
11
20out
GPS ANTENNA (ANTENNA UNIT)
20

SIGNAL TRANSMISSION CIRCUIT FOR CARRYING TRANSMISSION THROUGH A GLASS PLATE

BACKGROUND OF THE INVENTION

This invention relates to a signal transmission circuit for carrying out signal transmission between an antenna unit such as a GPS (global positioning system) antenna and a receiver body.

As well known in the art, a GPS receiver is an apparatus for detecting a current position of a mobile station for a user by receiving electric waves radiated on earth from a plurality of GPS (global positioning system) satellites which go over the earth.

As well known in the art, the GPS (global positioning system) is a satellite positioning system using military satellites under U.S. Department of Defense control that comprises twenty-four non-geostationary satellites in total, with six orbit surfaces every four satellites at an orbit height of about 20,000 km. The above-mentioned non-geostationary satellites (military satellites) are called GPS satellites. If the GPS receiver receives electric waves from four GPS satellites, it is possible to carry out a three-dimensional positioning. If the GPS receiver receives electric waves from three GPS satellites, it is possible to carry out a two-dimensional positioning.

In other words, the GPS is a global positioning system comprising twenty-four artificial satellites launched by the U.S. Department of Defense, a control station on earth, and mobile stations for users. By using the global positioning system, it is possible to calculate a position, a moving direction, and a moving speed of the mobile station by measuring distances between the mobile station and three or more GPS satellites on the basis of time intervals taken for arrival of the electric waves. Although the global positioning system was originally used for military affairs, presently it is widely applied to car navigation systems or the like. In addition, the mobile stations may be not only automobiles but also airplanes, ships, or the like.

Now, "car navigation" means to provide a driver information by displaying a position of a driver's driving car on a map of a car mounted machine at a real time, by displaying road traffic information, and by calculating the most suitable route up to a driver's destination.

Now, inasmuch as an electric wave called a GPS signal, which is generated by the GPS satellite and is arrived on the ground, has a very weak strength, the GPS signal may be buried in or covered with noises of electric waves on the ground. Accordingly, as the GPS signal, a PSK (Phase Shift Keying) wave which is spread spectrum modulated by using a PN (pseudo noise) code is used, and the GPS receiver comprises a LNA (low noise amplifier) circuit for extracting the GPS signal from the noises and for amplifying an extracted GPS signal.

Attention will be directed to the car navigation system where the mobile station is a car or an automobile. In this event, a GPS antenna (or an antenna unit) is mounted on an outer surface of a body of the car by using magnets or the like. Specifically, it will be assumed that the GPS antenna (or the antenna unit) is a planar-type antenna. The planar-type antenna may be mounted on a metallic roof panel of the car or the like by magnetically attracting the planar-type antenna to the metallic roof panel. The GPS antenna (or the antenna unit) comprises an antenna element and a circuit board on which accompanied circuit elements including the above-mentioned LNA circuit are mounted. Received by the GPS antenna (the antenna unit), a signal is transmitted to a GPS receiver body installed or loaded in the car or the automobile through a signal transmission circuit.

In prior art, transmission of a signal from the GPS antenna (the antenna unit) to the GPS receiver body (which will be merely called "signal transmission") is carried out through a coaxial cable. In other words, a conventional signal transmission circuit comprises the coaxial cable.

Inasmuch as the conventional signal transmission circuit comprises the coaxial cable as described above, the conventional signal transmission circuit is disadvantageous in that it is necessary to lead the coaxial cable from the GPS antenna (the antenna unit) to the GPS receiver body through a gap in the car or the automobile and it results in requiring a great deal of time.

In addition, those skilled in the art hit on an idea of a method comprising the step of carrying out the signal transmission by using only the above-mentioned coaxial cable as the signal transmission circuit through a glass plate of the car (for example, a front glass plate, a rear glass plate, or the like) without passing through the gap of the car. However, inasmuch as the coaxial cable has a low characteristic impedance of about 50 ohms, it is necessary to lower an impedance of its ground. As a result, an area of the ground in the glass plate must be made wide (large). To give an actual example, although the area of the ground differs from one glass plate to another, the area of the ground is equal, for example, to fifteen centimeters square, four centimeters square, or the like.

SUMMARY OF THE INVENTION

It is therefore an object of the present invention to provide a signal transmission circuit which is capable of carrying out signal transmission through a glass plate.

It is another object of the present invention to provide a signal transmission circuit of the type described, which is capable of reducing an area of a ground.

Other objects of this invention will become clear as the description proceeds.

The present inventors have been made extensive studies and considered various ideas in order to achieve a structure which needs not to widen (enlarge) the area of the ground in the glass plate on carrying out signal transmission through the glass plate. As described above, inasmuch as an unbalanced line such as a coaxial cable has low characteristic impedance of about 50 ohms, it is difficult to narrow (reduce) the area of the ground in the glass plate. Compared with this, inasmuch as a balanced line has higher characteristic impedance of, for example, about 200 ohms than that of the coaxial cable, it is possible to narrow (reduce) an area of a ground in the glass plate in comparison with a case of the coaxial cable. Accordingly, the present inventors arrived at a conclusion that it is possible to reduce the area of the ground in the glass plate by carrying out signal transmission between the glass plate using the balanced line having the high characteristic impedance and by using a balun in order to match between the unbalanced line (the coaxial cable) and the balanced line, to thereby make it possible to miniaturize the signal transmission circuit.

According to an aspect of this invention, a signal transmission circuit is provided for transmitting a signal received in an antenna unit to a receiver body through a glass plate. The antenna unit has an output terminal. The receiver body has an input terminal. The glass plate has first and second surfaces which are opposite to each other. The signal transmission circuit comprises a first coaxial cable having an end connected to the output terminal of the antenna unit. A second coaxial cable has an end connected to the input terminal of the receiver body. A first electrode pair consists of a pair of electrodes adhered to the first surface of the glass plate. A second electrode pair consists of a pair of electrodes adhered to the second surface of the glass plate at a position opposed to the first electrode pair. A first balanced line has an end pair connected to the first electrode pair. A second balanced line has an end pair connected to the second electrode pair. Disposed between another end of the first coaxial cable and another end pair of the first balanced line, a first balun is provided for impedance converting from the first coaxial cable to the first balanced line. Disposed between another end pair of the second balanced line and another end of the second coaxial cable, a second balun is provided for impedance converting from the second balanced line to the second coaxial cable.

The above-mentioned signal transmission circuit may be used in a global positioning system (GPS) receiver for use in a car navigation system. In this event, the antenna unit comprises a GPS antenna mounted on an outer surface of a body of a car. The receiver body comprises a GPS receiver body installed in the car. The glass plate comprises a glass plate of the car.

BRIEF DESCRIPTION OF THE DRAWING

FIG. 1 is a schematic circuit diagram of a signal transmission circuit according to an embodiment of this invention.

DESCRIPTION OF THE PREFERRED EMBODIMENT

Referring to FIG. 1, the description will proceed to a signal transmission circuit according to an embodiment of this invention. The illustrated signal transmission circuit shows an example applied to a GPS (global positioning system) receiver for use in a car navigation system.

As is well known in the art, the GPS receiver comprises a GPS antenna 20 serving as an antenna unit mounted on an outer surface of a body of a car (not shown) (i.e. outside the car) and a GPS receiver body 30 installed in the car. The GPS antenna 20 and the GPS receiver body 30 are connected through a signal transmission circuit 10 according to the illustrated embodiment of this invention. That is, the signal transmission circuit 10 is a circuit for transmitting a signal received by the antenna unit (the GPS antenna) 20 to the GPS receiver body 30 through a glass plate 40.

As described above, although illustration is not made, the antenna unit (the GPS antenna) 20 comprises an antenna element and circuit board mounting circuit elements including a low-noise amplifier (LNA) circuit thereon. The GPS antenna (the antenna unit) 20 has an output terminal $\mathbf{20}_{out}$ for outputting a signal received thereby to the exterior. The glass plate 40 may be a front glass plate of the car or a rear glass plate of the car. On the other hand, the GPS receiver body 30 has an input terminal $\mathbf{30}_{in}$ for inputting a signal from the exterior.

The signal transmission circuit 10 according to this invention is the circuit for signal connecting between the output terminal $\mathbf{20}_{out}$ of the GPS antenna (the antenna unit) 20 and the input terminal $\mathbf{30}_{in}$ of the GPS receiver body 30 through the glass plate 40. The term "signal connecting" as used herein means transmittably connecting a high frequency signal (not to transmit a DC signal such as a power transmission signal).

Although it is necessary to carry out feeding from the GPS receiver body 30 to the GPS antenna (the antenna unit) 20 in order to operate the GPS antenna (the antenna unit) 20, the feeding is carried out by a feeding circuit (not shown) which is different from the signal transmission circuit according to this invention. Inasmuch as such a feeding circuit is not directly related to this invention, description of the feeding circuit is omitted.

The signal transmission circuit 10 is divided into a first signal transmission part 11 and a second signal transmission part 12. The glass plate 40 has a first or outer surface 41 and a second or inner surface 42 opposite to the first surface 41. The first signal transmission part 11 is for transmitting the high frequency signal from the output terminal $\mathbf{20}_{out}$ of the GPS antenna (the antenna unit) 20 to the first surface 41 of the glass plate 40. The second signal transmission part 12 is for transmitting the high frequency signal from the second surface 42 of the glass plate 40 to the input terminal $\mathbf{30}_{in}$ of the GPS receiver body 30. In the manner known in the art, it is noted that the glass plate 40 transmits the high frequency signal because the glass plate 40 serves as a capacitor.

The first signal transmission part 11 comprises a first coaxial cable 111, a first electrode pair 112, a first balanced line 113, and a first balun 114. The first coaxial cable 111 has an end 111*a* connected to the output terminal $\mathbf{20}_{out}$ of the GPS antenna (the antenna unit) 20. The first electrode pair 112 consists of a pair of electrodes which are adhered to the first surface 41 of the glass plate 40. In addition, adhesion of the first electrode pair 112 to the first surface 41 of the glass plate 40 may be carried out, for example, by an adhesive agent, a magnet, double-sided tape, or the like. The first balanced line 113 has an end pair 113*a* connected to the first electrode pair 112. The first balun 114 is disposed between another end 111*b* of the first coaxial cable 111 and another end pair 113*b* of the first balanced line 113. The first balun 114 is a circuit used for matching the first coaxial cable 111 to the first balanced line 113. In other words, the first balun 114 impedance converts from the first coaxial cable 111 to the first balanced line 113. As the first balun 114, a balun which is well known in the art may be used, and detailed description thereof is therefore omitted. As is well known in the art, the first coaxial cable 111 comprises a central conductor 111-1 and an external conductor 111-2. The central conductor 111-1 is connected to the first balun 114 while the external conductor 111-2 is grounded.

The second signal transmission part 12 comprises a second coaxial cable 121, a second electrode pair 122, a second balanced line 123, and a second balun 124. The second coaxial cable 121 has an end 121*a* connected to the input terminal $\mathbf{30}_{in}$ of the GPS receiver body 30. The second electrode pair 122 consists of a pair of electrodes and is adhered to the second surface 42 of the glass plate 40 at a position opposite to the first electrode pair 112. In addition, adhesion of the second electrode pair 122 to the second surface 42 of the glass plate 40 may also be carried out, for example, by an adhesive agent, a magnet, double-sided tape, or the like. The second balanced line 123 has an end pair 123*a* connected to the second electrode pair 122. The second balun 124 is disposed between another end pair 123*b* of the second balanced line 123 and another end 121*b* of the second coaxial cable 121. The second balun 124 is a circuit used for matching the second balanced line 123 to the second coaxial cable 121. In other words, the second balun 124 impedance converts from the second balanced line 123 to the second coaxial cable 121. As the second balun 124, a balun which is well known in the art may be used, and detailed description thereof is therefore omitted. Likewise, the second coaxial cable 121 comprises a central conductor 121-1 and an external conductor 121-2. The central conductor 121-1 is connected to the second balun 124 while the external conductor 121-2 is grounded.

Inasmuch as each of the first and the second balanced lines 113 and 123 has characteristic impedance of about 200 ohms and is higher than that of the coaxial cable (about 50 ohms), it is possible to reduce areas of the first and the second electrode pairs 112 and 122 adhered to the first and the second surfaces 41 and 42 of the glass plate 40 in comparison with that of the coaxial cable. Accordingly, it is possible to miniaturize the signal transmission circuit 10. In addition, inasmuch as signal transmission is carried out through the glass plate 40, it is possible to drastically save trouble in comparison with a conventional case where the coaxial cable is led through a gap in the car or the automobile without the glass plate 40.

While this invention has thus far been described in conjunction with a preferred embodiment thereof, it will readily be possible for those skilled in the art to put this invention into practice in various other manners. For example, although the invention has been described above with respect to a case where the signal transmission circuit is applicable to the GPS receiver, the signal transmission circuit according to this invention may be generally applicable to any signal transmission through a glass plate.

What is claimed is:

1. A signal transmission circuit for transmitting a signal received in an antenna unit to a receiver body through a glass plate, said antenna unit having an output terminal, said receiver body having an input terminal, said glass plate having first and second surfaces which are opposite to each other, said signal transmission circuit comprising:

a first coaxial cable having an end connected to the output terminal of said antenna unit;

a second coaxial cable having an end connected to the input terminal of said receiver body;

a first electrode pair consisting of a pair of electrodes adhered to the first surface of said glass plate;

a second electrode pair consisting of a pair of electrodes adhered to the second surface of said glass plate at a position opposed to said first electrode pair;

a first balanced line having an end pair connected to said first electrode pair;

a second balanced line having an end pair connected to said second electrode pair;

a first balun, disposed between another end of said first coaxial cable and another end pair of said first balanced line, for impedance converting from said first coaxial cable to said first balanced line; and a second balun, disposed between another end pair of said second balanced line and another end of said second coaxial cable, for impedance converting from said second balanced line to said second coaxial cable.

2. A signal transmission circuit as claimed in claim 1, wherein said signal transmission circuit is used in a global positioning system (GPS) receiver for use in a car navigation system, said antenna unit comprising a GPS antenna mounted on an outer surface of a body of a car, said receiver body comprising a GPS receiver body installed in said car, said glass plate comprising a glass plate of said car.

* * * * *

UNITED STATES PATENT AND TRADEMARK OFFICE

CERTIFICATE OF CORRECTION

PATENT NO. : 6,538,610 B2
APPLICATION NO. : 09/973315
DATED : March 25, 2003
INVENTOR(S) : Junichi Noro It is certified that error appears in the above-identified patent and that said Letters Patent is hereby corrected as shown below:

In the Title Page (54), and column 1 line 2:

under item (54) Title, line 2, after "CARRYING "

insert --OUT SIGNAL--.

Signed and Sealed this

Twenty-fourth Day of October, 2006

JON W. DUDAS
*Director of the United States Patent and Trademark Office*